United States Patent [19]

Opitz et al.

[11] Patent Number: 4,600,447

[45] Date of Patent: Jul. 15, 1986

[54] AFTER-PASSIVATION OF PHOSPHATED METAL SURFACES

[75] Inventors: Reinhard Opitz, Dueren; Kurt Hosemann, Titz-Roedingen; Heinz Portz, Roesrath, all of Fed. Rep. of Germany

[73] Assignee: Henkel Kommanditgesellschaft auf Aktien, Duesseldorf, Fed. Rep. of Germany

[21] Appl. No.: 681,769

[22] Filed: Dec. 14, 1984

[30] Foreign Application Priority Data

Jan. 7, 1984 [DE] Fed. Rep. of Germany ..... 3400339

[51] Int. Cl.[4] ..... C23C 22/83

[52] U.S. Cl. ..... 148/6.15 R; 148/6.14 R

[58] Field of Search ..... 148/6.15 R, 6.14 R

[56] References Cited

U.S. PATENT DOCUMENTS

| | | | |
|---|---|---|---|
| 3,695,942 | 10/1972 | Binns | 148/6.15 |
| 3,852,123 | 12/1974 | Goltz | 148/6.14 |
| 3,895,970 | 7/1975 | Blum et al. | 148/6.15 |
| 3,957,543 | 6/1976 | Shinomiya et al. | 148/6.15 |

FOREIGN PATENT DOCUMENTS

| | | | |
|---|---|---|---|
| 966021 | 5/1975 | Canada . | |
| 0085626 | 10/1983 | European Pat. Off. . | |
| 2334342 | 1/1974 | Fed. Rep. of Germany . | |
| 0199873 | 11/1983 | Japan | 148/6.15 R |
| 0914652 | 3/1982 | U.S.S.R. | 148/6.15 R |

OTHER PUBLICATIONS

Die Phosphatierung von Metallen, E. Leuze Verlag, Saulgau, Germany (1974) W. Rausch.

*Primary Examiner*—Sam Silverberg

*Attorney, Agent, or Firm*—Ernest G. Szoke; Henry E. Millson, Jr.; Mark A. Greenfield

[57] ABSTRACT

A composition for the after-passivation of phosphated metal surfaces and a method for its use, the composition containing at least one water soluble salt of tetravalent titanium or divalent manganese, cobalt, nickel or copper.

20 Claims, No Drawings

AFTER-PASSIVATION OF PHOSPHATED METAL SURFACES

BACKGROUND OF THE INVENTION

1. Field of the Invention

This invention relates to a process for the after-passivation of phosphated metal surfaces.

2. Statement of Related Art

The protection of metal surfaces, particularly the protection of iron and steel surfaces, by phosphate-containing coatings has been known for some time. In this connection, a distinction is drawn between "nonlayer-forming phosphating", i.e. the use of alkali and/or ammonium orthophosphate solutions to produce iron phosphate coatings in which the iron ion emanates from the metal surface to be coated, and "layer-forming phosphating", in which zinc phosphate layers or zinc-/calcium phosphate layers are formed on metal surfaces using zinc or zinc/calcium phosphate solutions.

Phosphate coatings such as these not only improve the corrosion inhibition of the metal surfaces, they also increase the adhesion of lacquers subsequently applied to the surface. In addition, they are able in certain cases to contribute towards improving the properties of metal sheets for cold forming and for deep drawing.

Depending upon the composition of the solution used for phosphating, upon the accelerator used for the phosphating process, upon the process by which the phosphating solution is applied to the metal surfaces and/or upon other process parameters, the phosphate coating on the metal surface is not entirely without interruptions. Thus, more or less large uncoated spots or pores remain, and have to be eliminated or closed by after-passivation to ensure that corrosive influences on the metal surfaces do not have a starting point.

It has long been known that solutions containing chromium salts may be used for this purpose. In particular, the resistance to corrosion of the coatings produced by phosphating is considerably improved by aftertreatment of the surfaces with solutions containing hexavalent chromium.

A major disadvantage of using solutions containing chromium salts is that they are highly toxic. In addition, undesirable bubble formation during the subsequent application of lacquers or other coating materials is observed to an increasing extent.

For this reason, numerous other possibilities have been proposed for the after-passivation of phosphated metal surfaces, including the use of zirconium salts (U.S. Pat. No. 3,695,942, Canadian Pat. No. 966,021), cerium salts (U.K. Pat. No. 1,398,047, German published application No. 23 34 342), polymeric aluminium salts (U.S. Pat. No. 3,852,123, German published application No. 23 25 974), oligo- or polyphosphoric acid esters of inositol in conjunction with a water-soluble alkali or alkaline-earth metal salt of these esters (U.S. Pat. No. 3,957,543, German published application No. 24 03 022) or even fluorides of various metals including $TiF_4$ and $NiF_2$ (U.S. Pat. No. 3,895,970, Canadian patent No. 999,220, German published application No. 24 28 065).

Apart from the fact that fluorides are only used in exceptional cases in solutions suitable for after-passivation, because fluoride ions (and sulfate ions) are generally considered to have more of a corrosion-promoting effect, processes of the type in question have never been adopted by industry. Instead, the increasing demands for corrosion prevention have until now only been satisfied by sealing after rinsing with chromate-containing aqueous solutions [cf. W. Rausch, Die Phosphatierung von Metallen, E. Leuze Verlag, Saulgau, Germany (1974)].

Another process for treating metal phosphated surfaces is disclosed in European published patent application No. 85,626. In this process, metal surfaces are treated with aqueous solutions containing trivalent titanium cations and having an acidic pH value, after the phosphating step and before the application of coating materials. The trivalent titanium cation required for the after-passivation solution has to be produced by reduction from tetravalent titanium in a preceding reaction step, which means that the actual after-passivation step has to be preceded by a reduction reaction carried out in correspondingly elaborate reactors. In addition, the solutions disclosed in the above-mentioned application contain anions which have a highly corrosive effect upon parts of the equipment used (such as chloride and sulfate) and/or which are known to interfere with the passivation process (such as fluoride).

For the reasons explained above, it is highly desirable to replace chromium-containing solutions used almost exclusively for the after-passivation of phosphated metal surfaces by non-toxic solutions which do not give rise to bubble formation. However, the development of a universal process workable on an industrial scale for the efficient after-passivaticn of phosphated metal surfaces is a problem which had not until now been solved.

DESCRIPTION OF THE INVENTION

Other than in the operating examples, or where otherwise indicated, all numbers expressing quantities of ingredients or reaction conditions used herein are to be understood as modified in all instances by the term about The present invention relates to a process for the after-passivation of phosphated metal surfaces in which these surfaces are treated at temperatures of from 20 to 120° C. with acidic to neutral, aqueous solutions containing at least one cation from the group comprising divalent manganese, cobalt, nickel, copper, or tetravalent titanium.

The above cations are introduced into the solution in the form of salts which readily dissolve in water at the temperatures at which the process is conducted. Salts such as these are, preferably, salts of weak organic acids, such as methanoates (formates), ethanoates (acetates), propanoates (propionates), butanoates (butyrates) or 2,4-pentane dionoates (acetylacetonates). Particularly preferred salts are: (2,4-pentanedionoato)-tetravalent titanium oxide (titanyl acetylacetonate), divalent manganese ethanoate, divalent cobalt ethanoate, divalent nickel ethanoate, divalent copper ethanoate, or any mixture of the foregoing.

Solutions containing any one of the above cations are useful in this invention. Mixtures of the cations are preferred, particularly those mixtures disclosed below in Example 3 and 10 through 14; most particulary mixtures of: divalent nickel and divalent copper; divalent manganese and divalent cobalt; or divalent cobalt, divalent nickel, and tetravalent titanium.

The cation concentration should be that amount which is effective for the purposes of this invention, i.e., an after-passivation effective amount.

The aqueous solutions useful in this invention contain the above cations in quantities of 0.01 to 10 grams/liter (g/l) cation, provided that the total amount of cations does not exceed 10 g/l. When the cations are used individually, the preferred minimum concentration is 0.1 g/l and the preferred maximum concentration is 1 g/l. When mixtures of cations are used, the preferred minimum for each cation is 0.01 g/l, (0.05 being most preferred for divalent manganese, 0.05 being most preferred for divalent cobalt, and 0.03 being most preferred for divalent copper). The preferred maximum for a mixture of cations is 1 g/l., The pH of the useful solutions is in the acidic to neutral range, preferably from 3.0 to 7.0, most preferably 4.0 to 5.0. Adjustment may be made by adding acids such as ethanoic (acetic) or phosphoric, or bases such as sodium hydroxide, as needed.

The solutions according to this invention may be applied while at temperatures of 20° to 120° C., preferably 30° to 50° C.

The solutions may be applied to the surface being treated in any known manner, including (but not limited to) spraying, dipping, or any combination thereof.

The time of application (treatment) should be 30 seconds to 90 seconds, approximately one minute being preferred.

The general procedure for utilizing the solutions of this invention is, in sequence:

(a) rinsing a clean phosphated metal surface which is to be after-passivated with water;

(b) treating the surface with an inventive aqueous solution as described above under the conditions described above;

(c) rinsing, with low-ion-containing water (preferably fully deionized); and (d) drying in any known manner, preferably with compressed air.

The metal surfaces after-passivated by the process according to the invention are eminently suitable for subsequent coating with paints, lacquers, varnishes and the like. More particularly, the after-passivated metal surfaces form a substrate eminently suitable for cathodic electrodeposition, although they are also suitable for other aftertreatment processes.

The invention is illustrated by the following Examples.

EXAMPLE 1

To prepare an after-passivation solution, $Cu(CH_3COO)_2.H_2O$ was dissolved in water to form a solution containing 0.3 g/l, corresponding to 0.1 g/l of divalent copper cations.

Steel workpieces were then spray cleaned for 2 minutes at 50° C. with an alkaline cleaning solution and subsequently rinsed with water. They were then phosphated by spraying for 2 minutes at 50° C. with a zinc phosphate solution and subsequently rinsed with water.

The steel workpieces were then after-passivated by spraying for 1 minute at 35° C. with an after-passivation solution which contained 0.3 g/l of divalent copper ethanoate hydrate. The workpieces thus treated were then rinsed with fully deionized water and dried with compressed air.

The dried workpieces were coated with cathodic electrodeposition paint and dried for 20 minutes at 185° C. The dry film thickness of the paint amounted to 18 μm.

The workpieces were provided with individual cuts and salt-spray tested in accordance with German Industrial Standard (DIN) 50,021 for 480 h. Evaluation in accordance with Germa Industrial Standard (DIN) 53,167 revealed a creepage value of from 0.4 to 0.6 mm.

EXAMPLE 2

To prepare an after-passivation solution, $Ni(CH_3COO)_2.4H_2O$ was dissolved in water to form a solution containing 0.7 g/l corresponding to 0.17 g/l of divalent Ni cations. Steel workpieces were immersion-cleaned for 10 minutes at 80° C. with an alkaline cleaning solution and subsequently rinsed with water. The workpieces were then phosphated by immersion for 3 minutes at 50° C. in a zinc phosphate solution and again rinsed.

The solution containing 0.7 g/l of divalent nickel ethanoate tetrahydrate was used at 35° C. for after-passivation, the immersion time amounting to 1 minute. The after-passivated workpieces were rinsed with fully deionized water and dried with compressed air.

An electrodeposition paint was then cathodically applied and dried by heating for 20 minutes at 185° C. The paint had a dry film thickness of 18 μm.

The painted workpieces were then provided with individual cuts and salt-spray tested (in accordance with DIN 50,021) for 480 hours. Evaluation in accordance with DIN 53,167 produced a creepage value of from 0.4 to 0.6 mm.

EXAMPLE 3

To prepare an after-passivation solution, $Ni(CH_3COO)_2.4H_2O$ and $Cu(CH_3COO)_2.H_2O$ were dissolved in water to form a solution containing 0.5 g/l of divalent nickel ethanoate tetrahydrate and 0.1 g/l of divalent copper ethanoate hydrate. This corresponds to a content of 0.12 g/l of divalent Ni cation and 0.03 g/l of divalent Cu cation.

Steel workpieces were cleaned by immersion for 10 minutes at 80° C. in an alkaline cleaning solution and subsequently rinsed with water. They were then phosphated by immersion for 3 minutes at 50° C. in a zinc phosphate solution and again rinsed.

For after-passivation, the workpieces were immersed for 1 minute at 40° C. in the solution containing nickel and copper ions prepared in the manner described above, subsequently rinsed with fully deionized water and dried with compressed air.

The workpieces after-passivated in this way were then coated with a cathodic electrodeposition paint and dried by heating for 20 minutes at 185° C. The paint had a dry film thickness of 18 μm.

The workpieces were provided with individual cuts and salt-spray tested (in accordance with DIN 50,021) for 480 h. Evaluation in accordance with DIN 53,167 produced a creepage value of from 0.2 to 0.4 mm.

EXAMPLES 4 to 14

To prepare the after-passivation solutions, the cations listed in Table 1 were dissolved in water either individually (Examples 4 to 9) or in combination (Examples 10 to 14) to form solutions each containing 0.1 g/l of total cation(s). The salts used were the ethanoates (acetates) and (in the case of tetravalent titanium the 2,4-pentane dionoate (titanyl acetylacetonate).

Steel workpieces were spray-cleaned or immersion-cleaned with alkaline cleaning solutions and then rinsed with water as shown in Table 2. They were then phosphated with a zinc phosphate solution by spraying or immersion and subsequently rinsed with water.

The steel workpieces were then after-passivated with the after-passivation solutions containing the cations in the quantities indicated in Table 1, rinsed with fully deionized water and dried with compressed air.

The dried workpieces were coated with a cathodic electrodeposition paint and dried for 20 minutes at 185° C. The dry film thickness of the paint amounted to 18 μm.

The workpieces were provided with individual cuts and subjected for 30 days to the alternating climate test according to Volkswagen (VW) Standard P 12 10.

Evaluation in accordance with DIN 53,167 produced the results indicated in Table 1.

TABLE 1

| Example No. | After-passivation Cation | Quantity (g/l) | Temp. (°C.) | Time (mins.) | Creepage (mm) | Chipping (K) |
|---|---|---|---|---|---|---|
| 4 | $Mn^{2+}$ | 0.1 | 30 | 1 | 0.2–0.4 | 2–3 |
| 5 | $Co^{2+}$ | 0.1 | 30 | 1 | 0.2–0.4 | 2–3 |
| 6 | $Ti^{4+}$ | 0.1 | 30 | 1 | 0.2–0.4 | 2–3 |
| 7 | $Mn^{2+}$ | 0.1 | 30 | 1 | 0.2–0.4 | 2–3 |
| 8 | $Co^{2+}$ | 0.1 | 30 | 1 | 0.2–0.4 | 2–3 |
| 9 | $Ti^{4+}$ | 0.1 | 30 | 1 | 0.2–0.4 | 2–3 |
| 10 | $Mn^{2+}$ | 0.05 | | | | |
| | $Co^{2+}$ | 0.05 | 30 | 1 | 0.2–0.4 | 2–3 |
| 11 | $Mn^{2+}$ | 0.05 | | | | |
| | $Co^{2+}$ | 0.05 | 30 | 1 | 0.2–0.4 | 2–3 |
| 12 | $Mn^{2+}$ | 0.02 | | | | |
| | $Cu^{2+}$ | 0.08 | 30 | 1 | 0.2–0.4 | 2–3 |
| 13 | $Co^{2+}$ | 0.02 | | | | |
| | $Ni^{2+}$ | 0.08 | 30 | 1 | 0.2–0.4 | 2–3 |
| 14 | $Co^{2+}$ | 0.02 | | | | |
| | $Ni^{2+}$ | 0.07 | 30 | 1 | 0.2–0.4 | 2–3 |
| | $Ti^{4+}$ | 0.01 | | | | |

TABLE 2

| Example No. | Alkaline degreasing Time (mins.) | Alkaline degreasing Temp. (°C.) | Rinsing | Activation | Phosphating Time (mins.) | Phosphating Temp. (°C.) | Spraying | Immersion | Rinsing |
|---|---|---|---|---|---|---|---|---|---|
| 4 | 10 | 85 | x | x | 3 | 55 | | x | x |
| 5 | 10 | 85 | x | x | 3 | 55 | | x | x |
| 6 | 10 | 85 | x | x | 3 | 55 | | x | x |
| 7 | 2 | 60 | x | x | 3 | 55 | x | | x |
| 8 | 2 | 60 | x | x | 3 | 55 | x | | x |
| 9 | 2 | 60 | x | x | 3 | 55 | x | | x |
| 10 | 10 | 85 | x | x | 3 | 55 | | x | x |
| 11 | 2 | 60 | x | x | 3 | 55 | x | | x |
| 12 | 10 | 85 | x | x | 3 | 55 | | x | x |
| 13 | 2 | 60 | x | x | 3 | 55 | x | | x |
| 14 | 2 | 60 | x | x | 3 | 55 | x | | x |

What is claimed is:

1. A process for the after-passivation of clean phosphated metal surfaces consisting essentially of:

rinsing said clean phosphated metal surface with water;

treating said rinsed surface with an acid to neutral pH aqueous solution containing: about 0.01 to 10 g/l each of at least one cation selected from tetravalent titanium or divalent manganese, cobalt, nickel or copper, each said cation being present in the form of a water soluble salt with an organic anion and the total cation concentration not exceeding 10 g/l; and water q.s.; said solution being at a temperature of about 20° to 120° C.; said treatment exposure time being about 30 to 90 seconds;

after-rinsing said treated surface with low-ion-containing water; and drying said rinsed surface.

2. The process of claim 1 wherein said at least one cation is tetravalent titanium, present in a total cation concentration of about 0.1 to 1 g/l.

3. The process of claim 1 wherein said at least one cation is divalent manganese, present in a total cation concentration of about 0.1 to 1 g/l.

4. The process of claim 1 wherein said at least one cation is divalent cobalt, present in a total cation concentration of about 0.1 to 1 g/l.

5. The process of claim 1 wherein said at least one cation is divalent nickel, present in a total concentration of about 0.1 to 1 g/l.

6. The process of claim 1 wherein said at least one cation is divalent copper, present in a total concentration of about 0.1 to 1 g/l.

7. The process of claim 1 wherein said at least one cation is a mixture of cations.

8. The process of claim 1 wherein said at least one cation is a mixture of cations selected from:

(a) divalent manganese and divalent cobalt;

(b) divalent manganese and divalent copper;

(c) divalent cobalt and divalent nickel;

(d) divalent cobalt, divalent nickel, and tetravalent titanium; or (e) divalent nickel and divalent copper.

9. The process of claim 1 wherein the anion of each said water soluble salt is methanoate, ethanoate, propanoate, butanoate, or 2,4-pentane dioanoate.

10. The process of claim 8 wherein the anion of each said water soluble salt is methanoate, ethanoate, propanoate, butanoate, or 2,4-pentane dioanoate.

11. The process of claim 9 wherein said anion is 2,4-pentane dioanoate for the tetravalent titanium and an ethanoate for any other cation.

12. The process of claim 10 wherein said anion is 2,4-pentane dioanoate for the tetravalent titanium and an ethanoate for any other cation.

13. The process of claim 12 wherein said mixture is (a) and contains about 0.05 to 1 g/l of divalent manganese and about 0.05 to 1 g/l of divalent cobalt.

14. The process of claim 12 wherein said mixture is (e) and contains about 0.1 to 1 g/l of divalent nickel and 0.03 to 1 g/l of divalent copper.

15. The process of claim 12 wherein said mixture is (d) and contains 0.01 to 1 g/l of tetravalent titanium, 0.01 to 1 g/l of divalent cobalt, and 0.01 to 1 g/l of divalent nickel.

16. The process of claim 1 wherein said solution has a pH of about 3 to 7.

17. The process of claim 1 wherein said solution has a pH of about 4 to 5.

18. The process of claim 1 wherein said solution is at a temperature of about 30° to 50° C.; said treatment is by spraying, immersion, or any combination thereof; said after-rinsing is with fully deionized water; and said drying is by exposure to compressed air.

19. The process of claim 18 wherein: said solution contains any one said cation in a concentration of about 0.1 to 1 g/l or a mixture of said cations selected from (a) divalent manganese and divalent cobalt, (b) divalent manganese and divalent copper, (c) divalent cobalt and divalent nickel, (d) divalent cobalt, divalent nickel, and tetravalent titanium, or (e) divalent nickel and divalent copper; the anions of each said water soluble salt being methanoate, ethanoate, propanoate, butanoate, or 2,4-pentane dioanoate.

20. A process for the after-passivation of a clean phosphated metal surface comprising:

rinsing said clean phosphated metal surface with water;

treating said rinsed surface with an aqueous, about pH 4 to 5, about 30° to 50° C., solution for about 30 to 90 seconds, by spraying, immersion, or any combination thereof with said solution, said solution consisting essentially of at least one of tetravalent titanium 2,4-pentane dioanoate, divalent manganese ethanoate, divalent cobalt ethanoate, divalent nickel ethanoate, or divalent copper ethanoate, the total cation concentration being about 0.1 to 1 g/l when an individual salt is employed and about 0.2 to 1 g/l when a mixture of salts is employed;

after-rinsing said treated surface with fully deionized water; and drying said after-rinsed surface by exposure to compressed air.

* * * * *